US006470953B1

(12) United States Patent
Hirata et al.

(10) Patent No.: US 6,470,953 B1
(45) Date of Patent: Oct. 29, 2002

(54) MOLDING METHOD AND SYSTEM WITH A MOLDING APPARATUS

(75) Inventors: Minoru Hirata, Toyokawa (JP); Yutaka Hadano, Toyokawa (JP)

(73) Assignee: Singtokogio, Ltd., Aichi (JP)

( * ) Notice: Subject to any disclaimer, the term of this patent is extended or adjusted under 35 U.S.C. 154(b) by 0 days.

(21) Appl. No.: 09/570,681

(22) Filed: May 15, 2000

(30) Foreign Application Priority Data

Jan. 14, 2000 (JP) ..... 2000-005378

(51) Int. Cl.[7] ..... B22C 15/28

(52) U.S. Cl. ..... 164/37; 164/172; 164/456; 164/154.1

(58) Field of Search ..... 164/37, 40, 159, 164/169, 172, 187, 207, 154.1, 154.2

(56) References Cited

U.S. PATENT DOCUMENTS 2,959,828 A * 11/1960 Frankenstein ..... 22/45
3,503,436 A * 3/1970 Grolla ..... 164/172
3,586,093 A * 6/1971 Young ..... 164/173
3,589,431 A * 6/1971 Fellows ..... 164/172
4,915,159 A * 4/1990 Damm et al. ..... 164/456
5,332,025 A * 7/1994 Larsen ..... 164/456
5,618,484 A * 4/1997 Mogensen et al. ..... 264/220
5,682,941 A * 11/1997 Oda et al. ..... 164/154.2
5,947,185 A * 9/1999 Oda et al. ..... 164/456

FOREIGN PATENT DOCUMENTS

DE 0 263 977 B1 * 12/1991 ..... B22C/15/28
DE 0 673 698 A1 * 9/1995 ..... B22C/15/28

* cited by examiner

*Primary Examiner*—M. Alexandra Elve
*Assistant Examiner*—Kevin P. Kerns
(74) *Attorney, Agent, or Firm*—Gray Cary Ware & Freidenrich LLP

(57) ABSTRACT

A method and system using a molding apparatus with frames by which the amount of molding sand that overflows the molding apparatus and that must be taken out of a mold that is prepared by a molding operation is minimized, and by which the density of the mold within a frame is substantially uniform. The molding sand filling cavity is defined by a pattern plate, a molding frame that can be put on the pattern plate, a filling frame that can be put on the molding frame, and a covering apparatus having a plurality of squeezing feet. The squeezing feet can enter the filling frame and can be temporarily held at certain positions where certain distances are kept between the lower ends of the squeezing feet and surfaces of the patterns on the pattern plate that are opposed to the lower ends. Molding sand is supplied to the molding sand filling cavity. Then, the molding sand is compressed by the squeezing feet.

21 Claims, 8 Drawing Sheets

MOLDING METHOD AND SYSTEM WITH A MOLDING APPARATUS

FIELD OF INVENTION

The present invention relates to a molding method and system with a molding apparatus. More particularly, it relates to a molding method and system with a molding apparatus by which the density of a mold is made uniform, by which little molding sand overflows the molding apparatus, and by which the amount of any molding sand that must be removed from the mold is less compared to the prior art.

BACKGROUND OF THE INVENTION

A pattern plate is surrounded by a molding frame of a molding apparatus. Generally, the molding frame of the molding apparatus is filled with molding sand by letting it fall from a hopper by gravity. Then the molding sand projecting over the molding frame is swept out by a suitable member so that the upper surface of the molding sand may be flat.

A conventional molding apparatus supplies molding sand on an entire surface of a pattern plate regardless of different heights of the areas of the surface of the pattern plate. Thus, molding sand can overflow a molding frame when the molding sand fills it. Also, the density of the molding sand varies at various areas on a pattern plate according to the different heights of the patterns on the pattern plate, when the molding sand is squeezed.

Also, a conventional molding apparatus usually supplies molding sand to a molding frame at a constant in volume over time, so that the density of the molding sand differs at various positions on the pattern plate, although the feed of the molding sand to the molding frame must properly be changed according to the different shapes of patterns. Thus, when under that state the molding sand is squeezed, the resulting mold can project from the molding frame. In that case, the portion of the mold that projects over the upper level of the molding frame must be removed so that the upper surface of the mold may be aligned with the upper edge of the molding frame. Thus, a large amount of molding sand is wasted. Also, an apparatus for removing the molding sand is required. Also, the molding sand is spread when it is removed.

Accordingly, it is the principle object of this invention to provide a molding method and apparatus for a molding apparatus with a molding frame by which molding sand that overflows the molding frame and that must be removed from the molding frame decreases compared to the prior art, and by which the density of the molding sand within the molding frame can be made uniform after it is squeezed.

SUMMARY OF THE INVENTION

Thus, the object is achieved by a molding method for a molding apparatus with molding frames. This method include steps of defining a molding sand filling cavity by means of a pattern plate, a molding frame that can be put on the pattern plate, a filling frame that can be put on the molding frame, and a covering apparatus having a plurality of squeezing feet that can enter the filling frame and that can be temporarily held at certain positions where certain distances are kept between the lower ends of the squeezing feet and surfaces of patterns on the pattern plate, which surfaces are opposed to the lower ends, supplying molding sand to the molding sand filling cavity, and compressing the molding sand by means of the squeezing feet.

The capacity of the molding sand filling cavity is controlled by moving the respective squeezing feet up and down.

Also, the object is achieved by a molding method for a molding apparatus with molding frames wherein the capacity of the molding sand filling cavity is controlled by changing the distances between the surfaces of the patterns on the pattern plate and all the squeezing feet.

The positions of the respective squeezing feet are controlled when any part of the molding sand that is too much or too little is sensed. The distances between the surfaces of the patterns on the pattern plate and all the squeezing feet are controlled when too much or too little molding sand is sensed.

The step of sensing the molding sand that is partially too much or too little or too much or too little molding sand includes the steps of measuring reaction forces of the molding sand to the squeezing feet when the molding sand is squeezed in the molding sand filling cavity, and executing a calculation based on the measurements of the reaction forces.

The molding sand is supplied by supplying compressed air.

The molding sand is supplied through a plurality of nozzles.

The feed of the molding sand is changed by changing the amount of aeration to the nozzles according to the shapes of the patterns on the pattern plate.

A pressurized air flow or a pressurized air surge acts after the molding sand is supplied.

Based on past molding data any one of the capacity of the molding sand filling cavity, the positions and strength of the aeration, and the strength of the pressurized air flow or the pressurized air surge is controlled.

The past molding data is stored in a storage device of a controller of the molding apparatus with molding frames. Before the relevant operations are performed during the molding operation by the molding apparatus with molding frames, optimized values on the capacity of the molding sand filling cavity, the positions and strength of the aeration, and the strength of the pressurized air flow or the pressurized air surge are set.

The past molding data is connected to a computer that stores molding data for another molding apparatus through the controller of the molding apparatus with molding frames. The results of the calculation by the computer are used, so that optimized values on the capacity of the molding sand filling cavity, the positions and strength of the aeration, and the strength of the pressurized air flow or the pressurized air surge are set.

Also, the object is achieved by a molding system with molding frames having a pattern plate, a molding frame than can be put on the pattern plate, a filling frame that can be put on the molding frame, a covering apparatus having a plurality of squeezing feet that can enter the filling frame and that can be temporarily held at certain positions where certain distances are kept between the lower ends of the squeezing feet and surfaces of patterns on the pattern plate, which surfaces are opposed to the lower ends, and a sand supplying apparatus for supplying molding sand to the molding sand filling cavity that is defined by the pattern plate, the molding frame, the filling frame, and the covering apparatus, characterized by sensors for measuring reaction forces to respective squeezing feet, a storage device that stores molding data based on the measurements of the sensors for measuring reaction forces, and a distance calculation device for calculating distances between the lower ends of the squeezing feet relating to the molding sand filling cavity and the patterns on the pattern plate that are opposed to the lower ends of the squeezing feet.

The covering apparatus has a plurality of squeezing feet. They can pass through the plate of the covering apparatus and move up and down so that they jointly form an upper surface of the molding sand filling cavity.

Any molding sand that is partially too much or too little is sensed when the density of a part of the mold is high or low. Too much of too little molding sand is sensed when the density of all the molding sand is measured to be too high or too low.

The reaction forces to the plurality of the squeezing feet act when the molding sand is compressed. Those forces are sensed by respective sensors, for example.

The past molding data includes not only the molding data for the immediately prior molding, but also some molding data previous to it. When the capacity of the molding sand filling cavity etc. is controlled, the immediately prior molding data, as well as the data that is taken based on some of the previous data, is used. Also, the previous molding data is stored as a database, so that based on that data the capacity of the molding sand filling cavity etc. can be controlled by conventional methods such as a method of least squares and a fuzzy control method.

The past molding data is connected through a communication line such as the Internet and radio communications to a computer that stores molding data for another molding apparatus through the controller of the molding apparatus with molding frames.

BRIEF DESCRIPTIONS OF THE DRAWINGS

DESCRIPTIONS OF THE PREFERRED EMBODIMENTS

Figure 1:
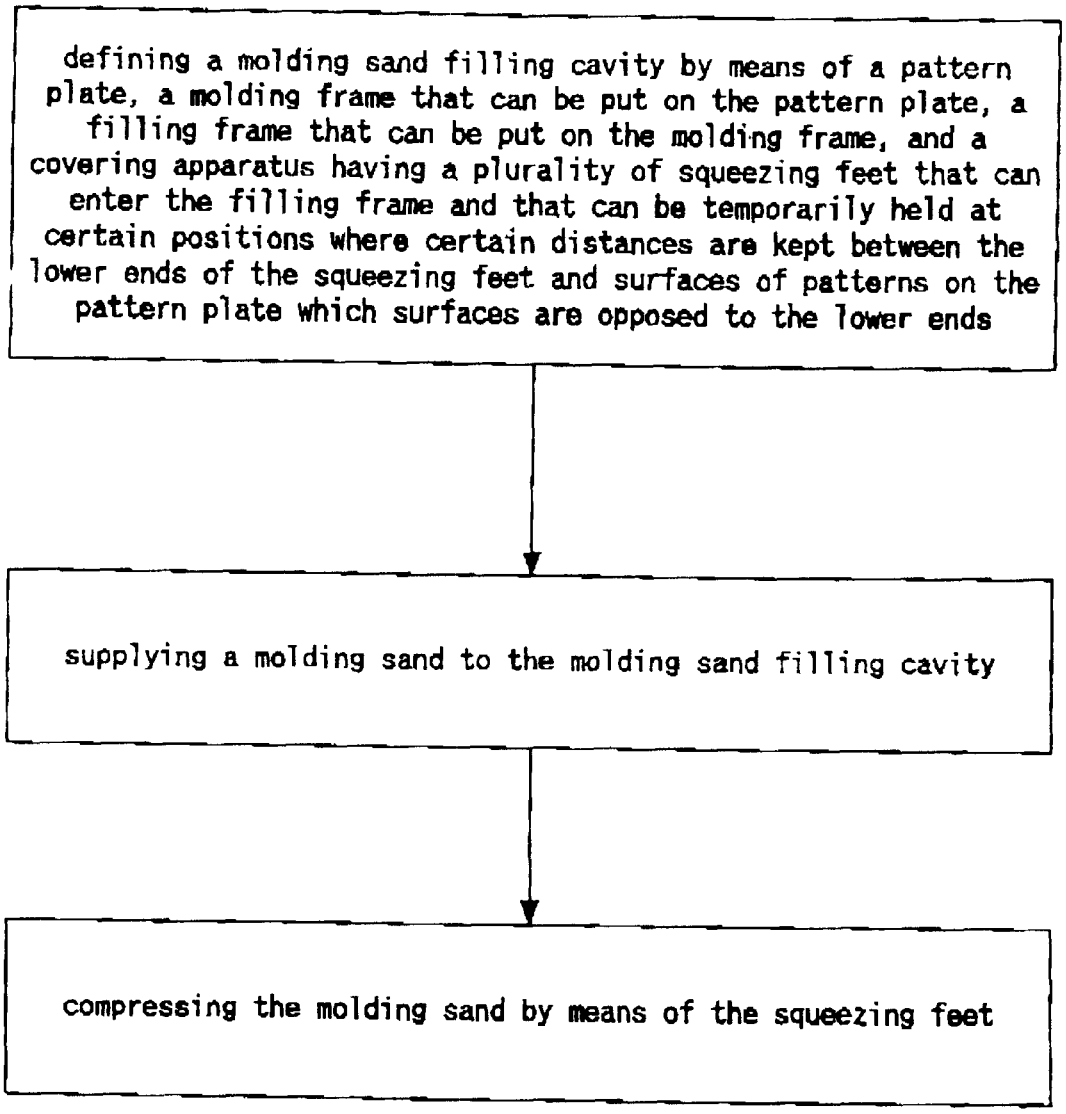
FIG. 1 shows a flowchart of a first embodiment of this invention.

Based on FIGS. 1–4 a first embodiment of this invention is now explained. FIG. 1 shows a flowchart of a molding method for a molding apparatus with a molding frame of this invention. The method includes steps of defining a cavity that is to be filled with molding sand, supplying molding sand to the cavity, and compressing the molding sand with a plurality of squeezing feet. The step of defining a cavity is performed by means of a pattern plate, a molding frame that is put on the pattern plate, a filling frame that is put on the molding frame, and a covering apparatus that has a plurality of squeezing feet. The squeezing feet are inserted into the space defined by the filling frame, so that they are arranged opposite respective portions of the casting pattern on the pattern plate. Also, the feet can temporarily be stopped so that certain distances are held between the squeezing feet and the corresponding portions of the casting pattern.

Figure 2:
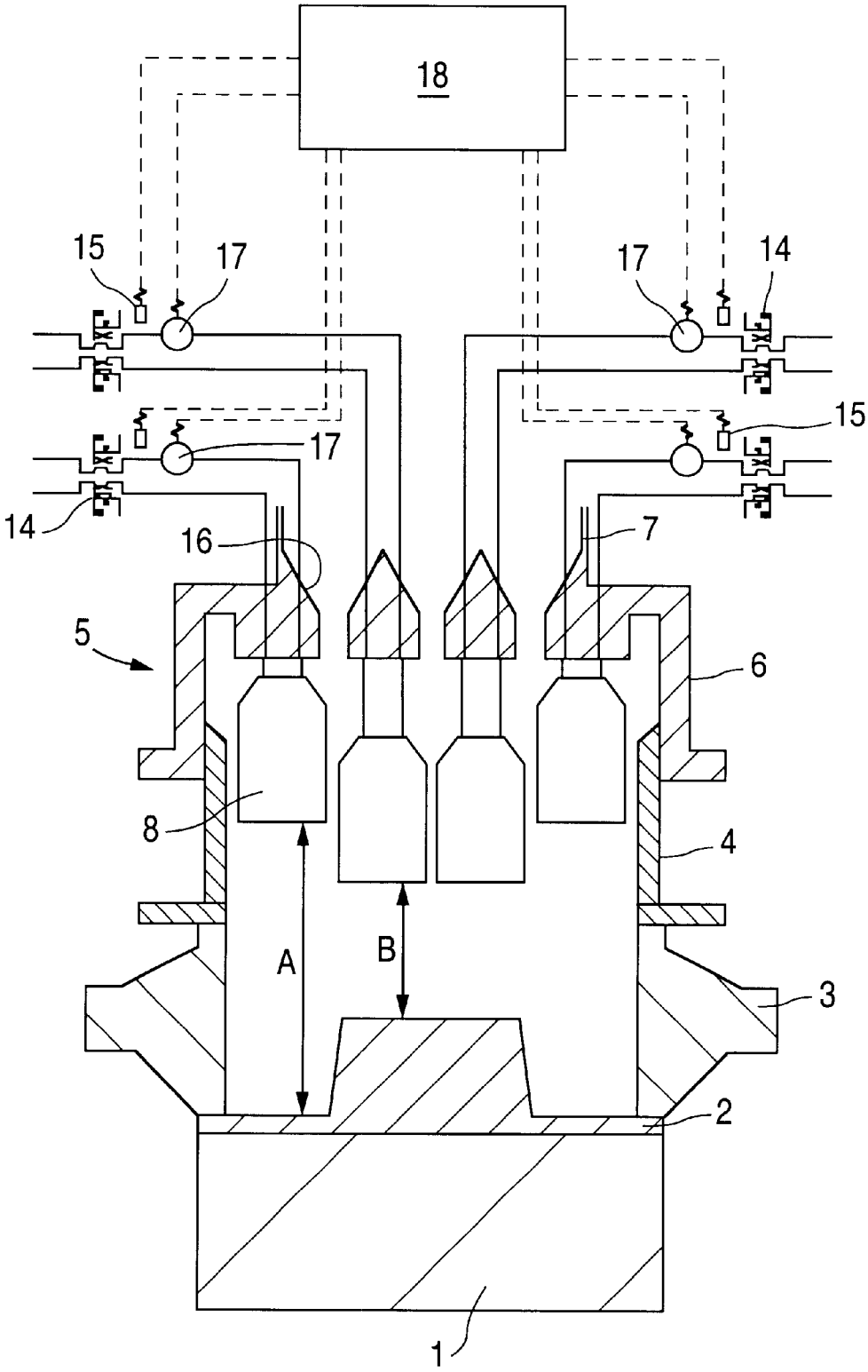
FIG. 2 is a cross sectional and plan view showing the main part of a molding sand filling cavity of the first embodiment of this invention where the molding sand has not yet been supplied to it.

FIG. 2 is a cross sectional and front view of a main part of a molding apparatus that includes a mechanism to supply molding sand to molding frames and a squeezing apparatus. A pattern plate 2 is disposed on a moving table 1, which is intermittently and horizontally moved by means of a conventional mechanism (not shown). A molding frame 3 is horizontally and vertically transported over the pattern plate 2 by a frame transporting apparatus (not shown), so that the frame 3 can be put on the pattern plate 2 when the moving table 1 temporarily stops at a certain position. A covering apparatus 5 is disposed above the molding frame 3 that is stopped at a certain position. The covering apparatus 5 has a plurality of squeezing feet and a filling frame 4. The frame 4 is hung from the covering apparatus 5. The frame 4 can move up and down over a certain distance from the lower end of the covering apparatus 5. The covering apparatus can be moved up and down by means of an actuator (not shown).

The plurality of the squeezing feet 8 are positioned along the center of the covering apparatus 5 and perform the squeezing operation. The covering apparatus 5 has a holding member 6, which is shaped like an inverted box, from which the filling frame 4 is hung. The filling frame 4 can move up and down over a certain distance along the holding member 6. A square tubular hopper 7 is located on the upper surface of the holding member 6 as a sand supplying apparatus. The hopper 7 has a plurality of nozzles at the lower end so as to supply molding sand. A plurality of the squeezing feet 8 are arranged like a grid within a lower cavity defined by the holding member 6. The feet can be moved up and down within the lower cavity. Each foot 8 is shaped cylindrically.

Figure 8:
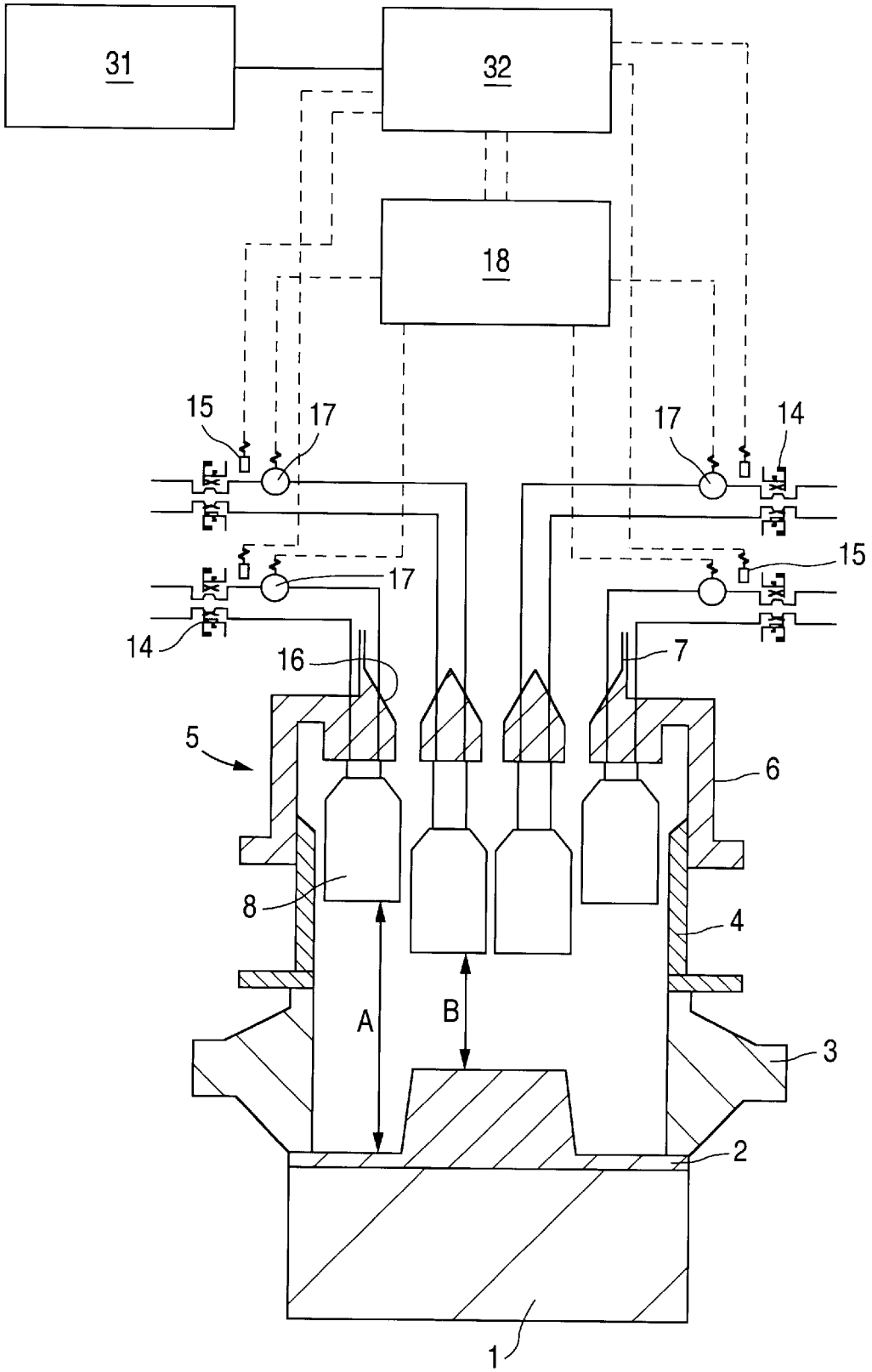
FIG. 8 is a cross sectional and plan view showing the main part of the molding sand filling cavity of the third embodiment of this invention where the molding sand has not yet been supplied to it.

As in FIG. 8, each foot 8 is shaped like a cylinder so that the lower part of the foot is closed by a plate while the upper end of it is closed by a plate that has a hole 9. Those plates can be fixed to the foot by means of bolts. A piston rod 11 is inserted into the foot 8 after it passes through the hole 9. A piston 10 is integrally combined with the piston rod 11. The upper end of the piston rod 11 is fixed to the holding member 6. The foot 8 can be slidably and relatively moved up and down along the piston rod 11.

A first channel 12 is formed in each piston rod 11 along it and passes through the piston 10. Also, a second channel 13 is formed in each piston rod 11 along it, but that channel does not pass through the piston 10. The first and second channels 12 and 13 are connected through a directional control valve 14 to an oil-pressure unit (not shown). Also, a pressure sensor 15 and a flow-control valve 17 are connected to a line between each first conduit 12 and each directional control valve 14. The pressure sensor 15 operates as a reaction force measurement apparatus to measure the reaction forces that are caused to the squeezing feet 8 of the covering apparatus when the molding sand in the sand filling cavity is squeezed. The flow-control valve 17 controls the flow rate of pressure oil that flows in the first conduit 12. A microcomputer 18 is electrically connected to the pressure sensors 15 and the directional control valves 17. A safety valve or a relief valve may be connected to each line between the first channel 12 and the flow-control valve 17. The microcomputer 18 operates as a distance calculating apparatus. Based on the results of the measurements of the sensors 15, it calculates the distances between the surfaces of patterns on the pattern plate and the lower ends of the squeeze feet, which ends oppose those surfaces, for the next squeezing operation in the sand filling cavity.

Thus, as in FIG. 2, the squeeze feet are held at certain positions so that the ratios of the distances between the surfaces of the patterns on the pattern plate and the lower ends of the squeeze feet before a squeezing operation is performed to those after a squeezing operation is finished can nearly equal each other. For example, if the distances between the surfaces of the patterns on the pattern plate and the lower ends of the squeeze feet before a squeezing operation is performed are A and B (as in FIG. 2), and if the distances after a squeezing operation is finished are $\underline{a}$ and $\underline{b}$ to B (as in FIG. 4), the relationship between the ratio of $\underline{a}$ to A ($\underline{a}$/A) and the ratio of ($\underline{b}$/B) is controlled so that the relationship may approximate the relationship of $\underline{a}$/A=$\underline{b}$/B.

Figure 5:
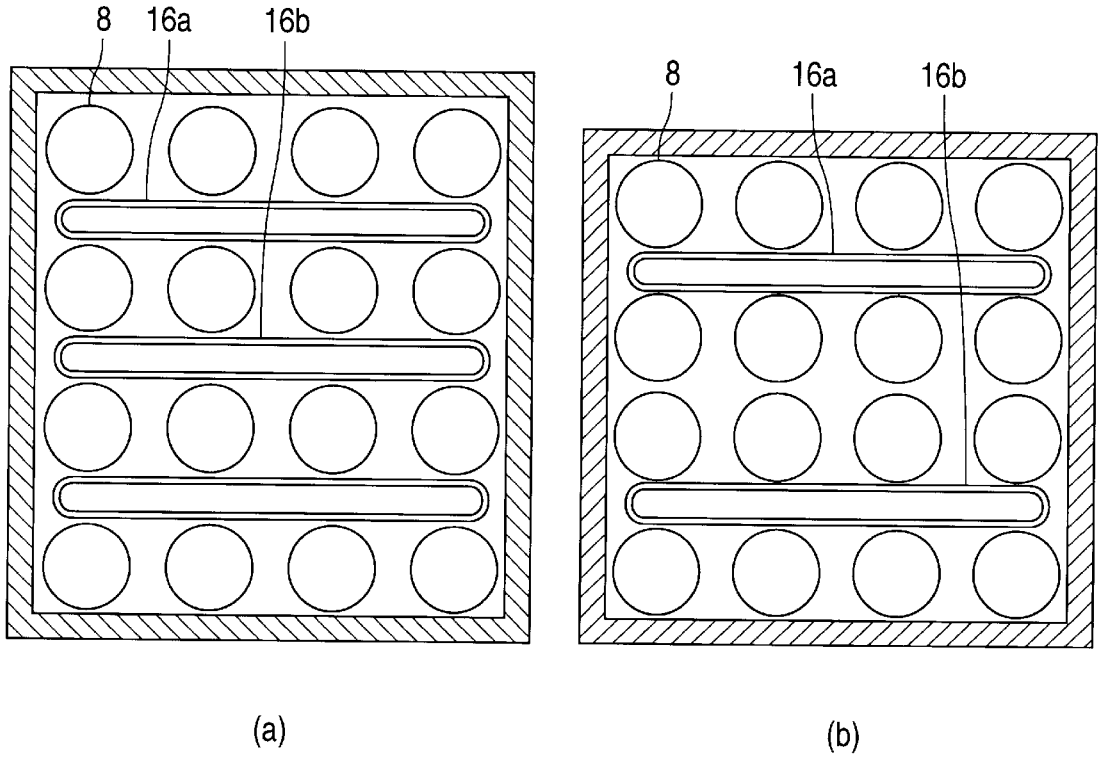
FIG. 5 is a plan view showing an example of a position and a shape of nozzles and squeezing feet.

Nozzles 16 are formed within each of the cavities that are surrounded by a plurality of the squeezing feet 8 and are defined by the holding member 6. Each nozzle 16 is funneled. The outlet of each nozzle 16 is optional. It may be shaped to be circular, elliptical, rectangular, square, etc. Also, such shapes may be combined. The nozzle is not limited to have the shape of a funnel. It may have other shapes (as in FIG. 5). An aeration is performed bypassing air through the nozzles 16. The air is pressurized by, for example, a compressor (not shown) so as to cause the aeration. The aeration is performed for each nozzle 16. The degree of aeration is changed for each nozzle, so that the amount of molding sand that is supplied to the cavity through the nozzles can be changed according to the patterns on the pattern plate. For example, in FIG. 5 the aeration is performed through the nozzles 16*a* and 16*b*, or the aeration is performed through a part of the nozzle 16*a*, so that the amount of molding sand that is supplied through these nozzles or the part can be increased over the prior art. For example, an electromagnetic valve is used to open or close all or some of the nozzles or part of each nozzle.

Figure 3:
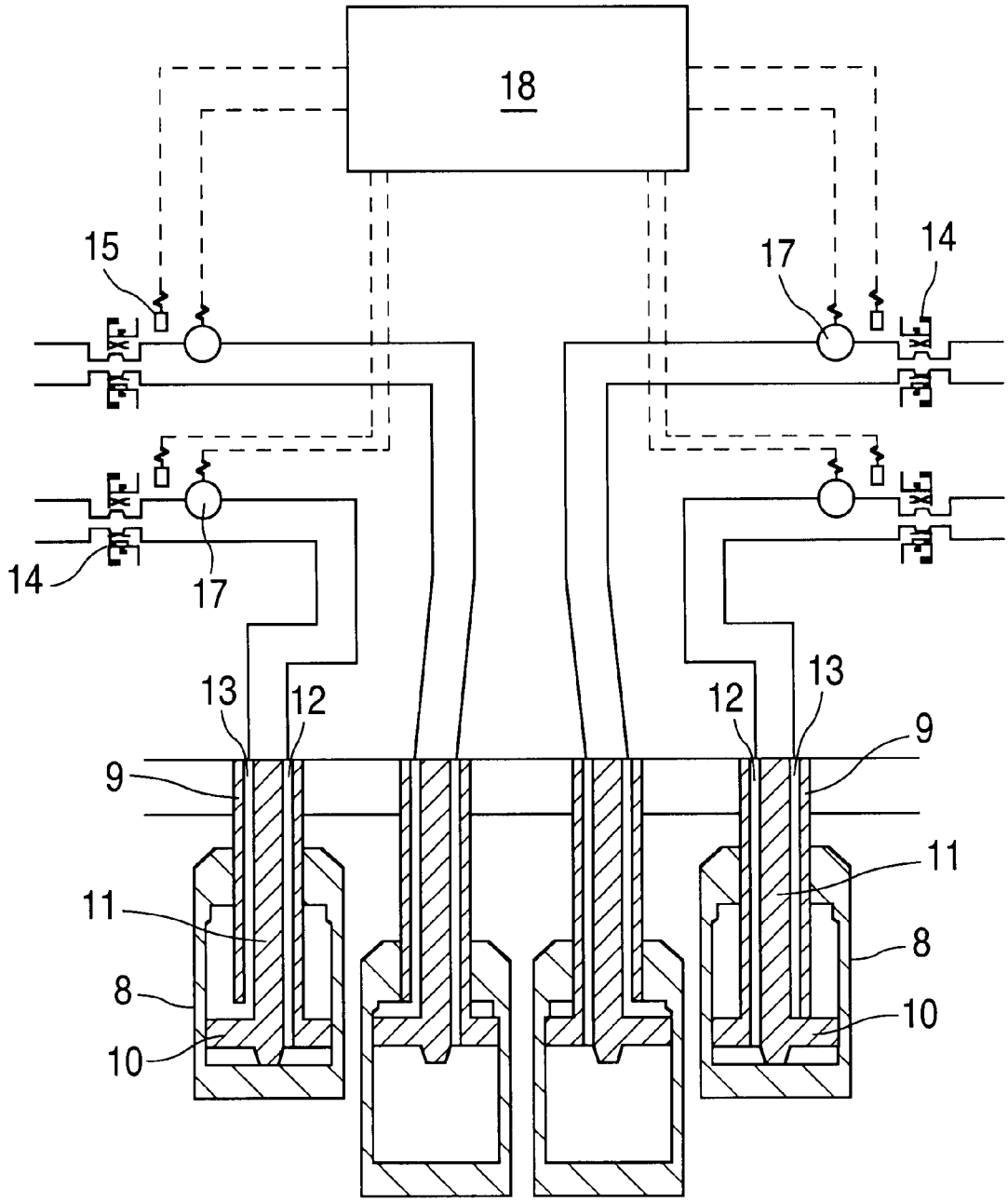
FIG. 3 shows an expanded view of the main part as in FIG. 2.

Based on FIGS. 2 and 3, we now explain how the density of the mold can be substantially uniform within the molding frame 3 by means of the apparatus explained above.

As in FIG. 2, the step of defining the molding sand filling cavity allows the molding sand filling cavity to be defined by means of the pattern plate 2, the molding frame 3, which is to be put on the pattern plate 2, the filling frame 4, which is to be put on the molding frame 3, and the covering apparatus 5, which has a plurality of the squeezing feet 8, which squeezing feet can be inserted into the filling frame 4. Also, the squeezing feet 8 can be temporarily held at certain positions so that the lower ends of the squeezing feet and the surfaces of the patterns on the pattern plate are opposed and so that certain distances can be kept between them.

That is, as in FIG. 2, the molding frame 3 is put on the pattern plate 2, then the filling frame 4 is put on the molding frame 3, and then the covering apparatus 5, which has the squeezing feet, is put on the filling frame 4. Then, as necessary some of the directional-control valves 14 are exchanged, so that pressurized oil is supplied through the relevant first channels 12 to the spaces that are defined by the pistons 10 and the squeezing feet 8. This allows the squeezing feet 8 to be moved down, as in FIG. 2, so that the distances A and B are kept between the lower ends of the squeezing feet 8 and the corresponding surfaces of the patterns of the pattern plate 2. The distances A and B are selected so that the ratios of them to those that will be determined may be substantially close to each other. That is, the squeezing feet 8 that are positioned opposed to the patterns on the pattern plate that are relatively high are moved down so that the amount of molding sand that is to be compressed may be decreased compared to the prior art. In contrast, the squeezing feet 8 that are positioned opposed to the patterns on the pattern plate that are relatively low are moved down just a little so that the amount of molding sand that is to be compressed may increase. Thus, this allows the molding sand filling cavity to be defined by the pattern plate 2, the molding frame 3, the filling fame 4, and the plurality of the squeezing feet 8.

Then, molding sand is supplied by molding sand supplying mechanism (not shown) to the sand hopper 7, which is positioned at the upper part of the covering apparatus 5, which has a plurality of the squeezing feet 8, so that the molding sand is supplied from the sane hopper 7 through a plurality of the nozzles 16 to the molding sand filling cavity.

Figure 4:
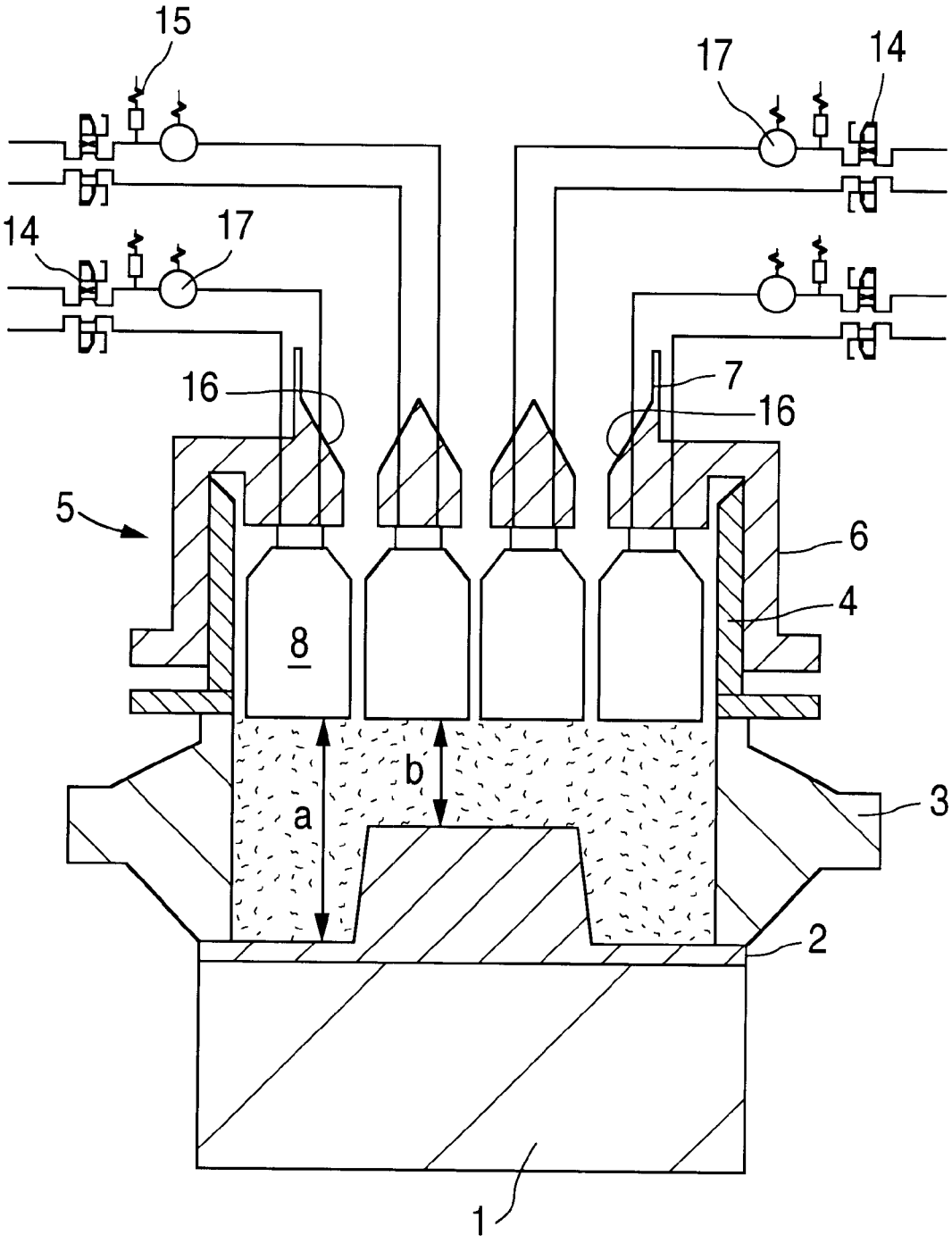
FIG. 4 shows a cross sectional and plan view of the molding sand filling cavity of the first embodiment of this invention where the molding sand is squeezed.

Then, as in FIG. 4, the covering apparatus 5, which has a plurality of the squeezing feet 8, is moved down by an actuator not shown, so that the holding sand within the molding sand filling cavity is squeezed by the plurality of the squeezing feet 8. If the reaction force of the molding sand to the squeezing feet 8 become greater than the downward forces of the squeezing feet when the squeezing feet operate, then those squeezing feet will be moved relatively up to the upper position as the covering apparatus moves down, since the relief valve operates to release the oil from the second channels 13. When the covering apparatus 5 moves down to a certain position, all the squeezing feet 8 are moved to the upper position, so that the surface of the molding sand is flat and so that the mold is uniformly squeezed.

When the squeezing operation is completed, the reaction forces of the molding sand to the squeezing feet 8 (that is, the density of the mold) are sensed by the pressure sensor 15. Based on this measurement, to adjust the positions of the squeezing feet 8 within the molding sand filling cavity a microcomputer 18 generates an order signal to suitably control flow-control valves 17 that were selected for the previous squeezing operation when the molding sand was supplied to the molding sand filling cavity. Also, the amount of molding sand that is supplied to the molding sand filling cavity is increased or decreased, so that the density of the mold that is determined when the squeezing operation is performed becomes uniform or the reaction forces that are caused when the squeezing operation is performed become the same.

In the embodiment stated above, oil pressure is used for a driving source to move the squeezing feet. Air pressure may also be used for the driving source. Also, the squeezing feet may be electrically moved. In the case of air pressure, the directional control valve is connected to an air driving source such as an air unit. Also in the case of air pressure, both of the pressures in the spaces that are connected to the first and second channels 12, 13 are controlled, so that the respective positions of the squeezing feet 8 can be gradually adjusted at the upper, middle, and lower positions, etc. Also, the position of the filling frame 6, to which the squeezing feet is connected, is moved up and down, so that all the distances between the lower ends of the squeezing feet and the opposed surfaces of the patterns on the pattern plate can be synchronously adjusted.

Figure 6:
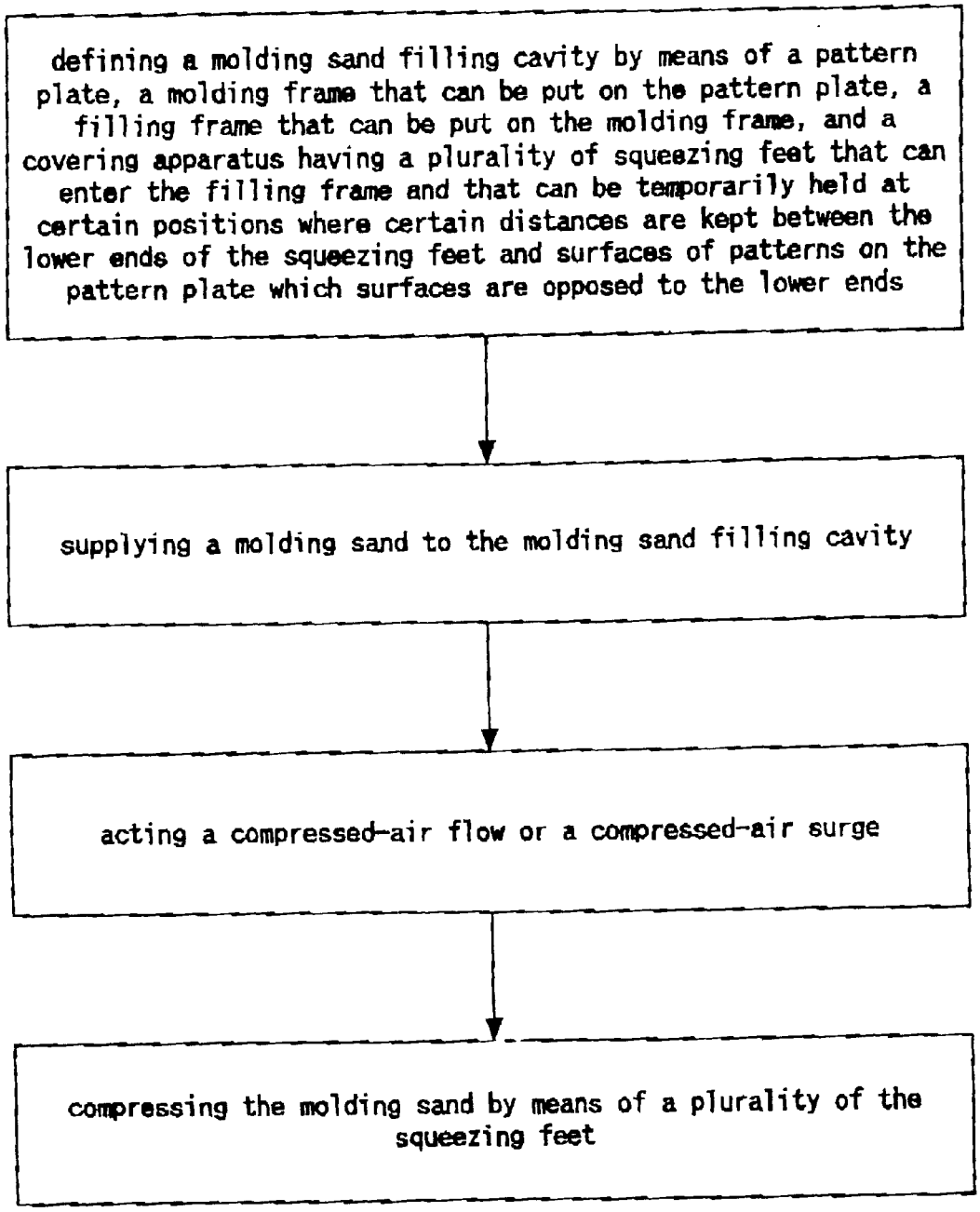
FIG. 6 shows a flowchart of a second embodiment of this invention.

Now we explain a second embodiment of this invention. FIG. 6 shows a flowchart of a squeezing operation that is performed by the second embodiment. This flowchart differs from that for the first embodiment in that after a molding sand hopper is filled with molding sand, a pressurized air flow or a pressurized air surge acts on the molding sand, and then the molding sand is compressed by the squeezing feet.

Figure 7:
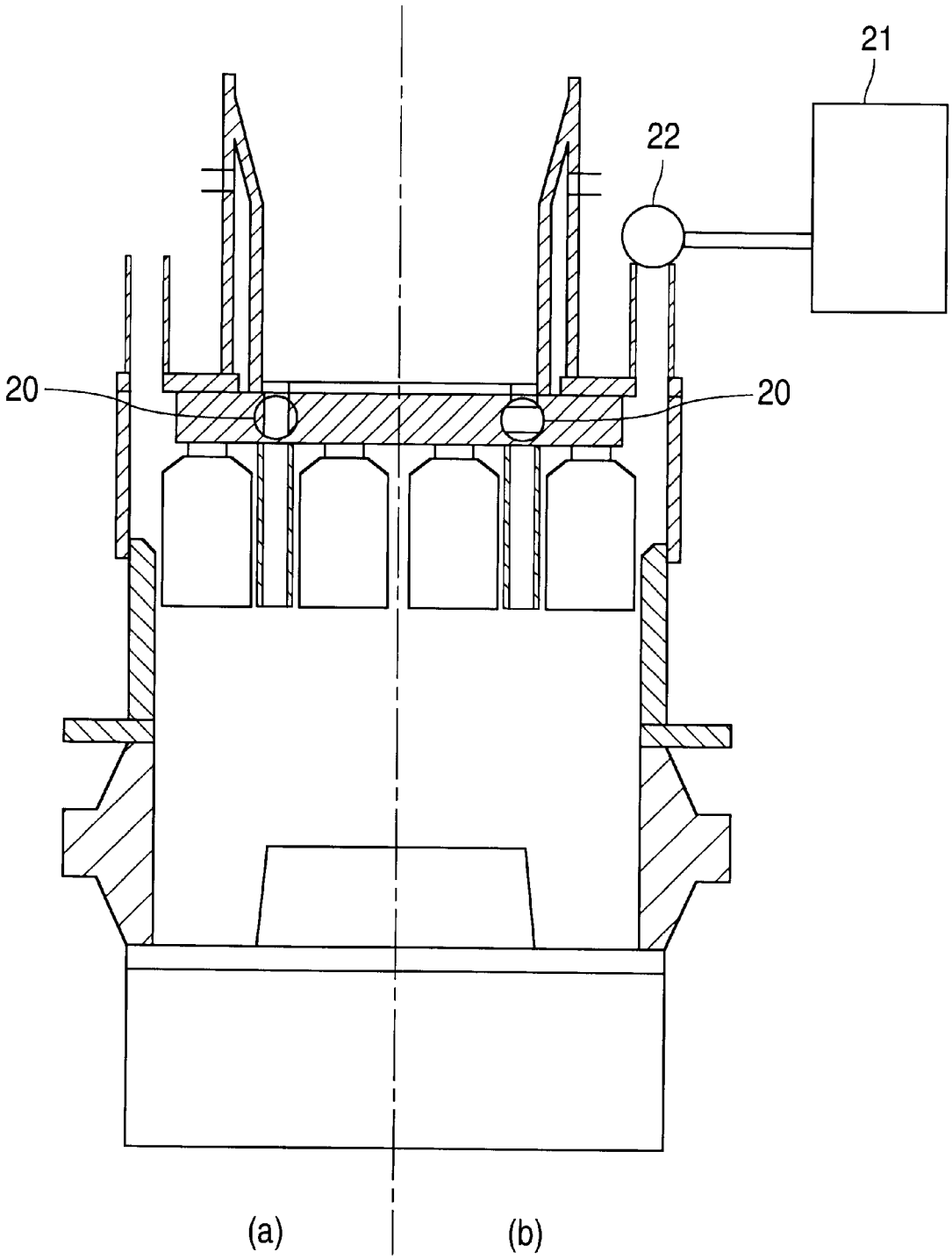
FIG. 7 is a cross sectional and plan view showing the main part of an apparatus of the second embodiment of this invention.

As in FIG. 7, the second embodiment of this invention includes valves 20 that close the outlets of the nozzles to prevent air from flowing into the molding sand cavity when a pressurized air flow or a pressurized air surge acts, and includes an air supplying apparatus. FIG. 7 shows the half of the apparatus denoted by (a). It shows the valve 20 being open. FIG. 7 also shows the half of the apparatus denoted by (b). It shows the valve 20 being closed. When the valve 20 is closed, such a pressurized air flow can be supplied. If the pressure of the pressurized air flow is low, the valve does not need to be closed. The air supplying apparatus includes an air tank 21 and air valve 22. The computer is electrically connected to them to control the pressure of the air that is supplied by the air tank 21 and the opening angle of the air valve 22.

The apparatus of this second embodiment allows the molding sand to be preliminarily compressed after it is supplied to the molding space. Also, the compressed-air flow can highly compress the surfaces of the mold that contact the sides of the patterns on the pattern plate. The pressurized air surge can highly compress the rear side of the mold.

A third embodiment of this invention is now explained. FIG. 8 shows a schematic view of a molding apparatus of this embodiment. The molding apparatus includes a controller 31 to which a storage device 32 is connected. It stores past molding data. Various sensors are electrically connected to the controller 31, so that signals are transmitted from the sensors to the controller 31 and then are stored in the storage device 32. Molding data such as on the density of the mold and the capacity of the molding sand filling cavity is taken by a pressure sensor etc. Such data is used to control the capacity of the molding sand filling cavity, the positions and strength of the aeration, and the strength of the pressurized air flow or the pressurized air surge.

Before the relevant steps are performed by the molding apparatus with frames, the past molding data is calculated and sent to the actuators.

Also, the past molding data can be sent through the controller of the molding apparatus with frames to a computer of another molding apparatus (not shown) that is used to store molding data. A central computer, a data server-type computer, etc. may be used for such a computer. The results calculated by the computer are transmitted to a controller of an operational molding apparatus, so that the capacity of the molding sand filling cavity, the positions and strength of the aeration, and the strength of the pressurized air flow or the pressurized air surge can be optimized.

Also, a computer that stores sand-mixing or sand-processing data can be connected to the controller of the molding apparatus with frames, so that based on that data the optimal value on the capacity of the molding and filling cavity, the positions and strength of the aeration, and the strength of the pressurized air flow or the pressurized air surge can be set. In that case, the compactability of the molding sand (that represents what percent of the molding sands is compressed when a certain test load bears on it) and the water content of the molding sand are used as sand mixing data. The data is stored in a computer that is electrically connected to a mixing controller that a mixing apparatus has. Based on the data, the capacity of the molding sand filling cavity, the positions and strength of the aeration, and the strength of the pressurized air flow or the pressurized air surge can be controlled. Thus, molding data can be commonly used between the computers, so that it ensures that a more precise control can be achieved.

According to the molding method for a molding apparatus with molding frames, it includes steps of defining a molding sand filling cavity by means of a pattern plate, a molding frame that can be put on the pattern plate, a filling frame that can be put on the molding frame, and a covering apparatus having a plurality of squeezing feet that can enter the filling frame and that can be temporarily held at certain positions where certain distances are kept between the lower ends of the squeezing feet and surface of patterns on the pattern plate, which surfaces are opposed to the lower ends, supplying molding sand to the molding sand filling cavity, and compressing the molding sand by means of the squeezing feet. Thus, the molding sand that must be removed can be minimized. Also, the density of the mold within the molding frame can be uniform.

According to the molding method for a molding apparatus with molding frames wherein the capacity of the molding sand filling cavity is controlled by moving the respective squeezing feet up and down, the molding sand that must be removed can be minimized. Also, the density of the mold within the molding frame can be uniform.

According to the molding method for a molding apparatus with molding frames wherein the capacity of the molding sand filling cavity is controlled by changing the distances between the surfaces of the patterns on the pattern plate and all the squeezing feet, the molding sand filling cavity can be defined so as to prevent any lack of molding sand in the entire mold. Also, the density of the mold within the molding frame can be uniform.

According to the molding method for a molding apparatus with molding frames wherein the positions of the respective squeezing feet are controlled when it is sensed that any part of the molding sand is too much or too little, and wherein the distances between the surfaces of the patterns on the pattern plate and all the squeezing feet are controlled when too much or too little molding sand is sensed, the entire mold can be prevented from lacking any molding sand. The molding sand filling cavity can be accurately defined. The molding sand that must be removed can be minimized. Also, the density of the mold within the molding frame can be uniform.

According to the molding method for a molding apparatus with molding frames wherein the step of sensing the molding sand that is partially to much or too little or that is entirely too much or too little includes the steps of measuring the reaction forces of the molding sand to the squeezing feet when the molding sand is squeezed in the molding sand filling cavity, and executing a calculation based on the measurements of the reaction forces, the molding sand filling cavity can be accurately defined. The molding sand that must be removed can be minimized. Also, the density of the mold within the molding frame can be uniform.

According to the molding method for a molding apparatus with molding frames wherein the molding sand is supplied by supplying compressed air, the amount of molding sand that overflows the molding frame when the molding sand is supplied to it can be decreased over the prior art.

According to the molding method for la molding apparatus with molding frames wherein the molding sand is supplied through a plurality of nozzles, portions of the mold where it is difficult to supply the molding sand can be removed.

According to the molding method for a molding apparatus with molding frames wherein the feed of the molding sand is changed by changing the amount of aeration to the nozzles according to the shapes of the pattern plate, the feed of the molding sand can be easily changed according to the patterns on the pattern plate. Thus, the molding apparatus can have flexibility because the positions and strength of the supplied compressed air can be changed.

According to the molding method for a molding apparatus with molding frames wherein a pressurized air flow or a pressurized air surge acts after the molding sand is supplied, the precompression allows the mold to be more highly compressed so that its density is uniform.

According to the molding method for a molding apparatus with molding frames wherein based on past molding data any one of the capacity of the molding sand filling cavity, the positions and strength of the aeration, and the strength of the pressurized air flow or the pressurized air surge is controlled, the molding apparatus becomes stable, so that the molding sand that must be removed can be minimized. Also, the density of the mold within the molding frame can be uniform.

According to the molding method for a molding apparatus with molding frames wherein the past molding data is stored in a storage device of a controller of the molding apparatus with molding frames, and wherein before the relevant operations are performed during the molding operation by the molding apparatus with molding frames optimized values on the capacity of the molding sand filling cavity, the positions and strength of the aeration, and the strength of the pressurized air flow or the pressurized air surge are set, the previous data can be effectively used. This method can essentially be used for a molding operation where molding sand that has variable factors is molded.

According to the molding method for a molding apparatus with molding frames wherein the past molding data is connected to a computer that stores molding data for another molding apparatus through the controller of the molding apparatus with molding frames, and wherein the results calculated by the computer are used, so that optimized values on the capacity of the molding sand filling cavity, the positions and strength of the aeration, and the strength of the pressurized air flow or the pressurized air surge are set, the molding data can be used for various molding apparatuses that even have different sizes, different types, and different positions and strengths of compressed-air flows and aeration.

According to the molding method for a molding apparatus with molding frames wherein the past molding data is also connected to a computer that stores sand processing or sand mixing data through the controller of the molding apparatus with molding frames, and wherein by making reference to the sand processing or sand mixing data optimized values on the capacity of the molding sand filling cavity, the positions and strength of the aeration, and the strength of the pressurized air flow or the pressurized air surge are set, the molding sand processing data and the molding sand mixing data can be used so that the molding can surely be performed according to the type of molding sands.

According to the molding method for a molding apparatus with molding frames wherein the sand mixing data relates to the compactability of the molding sand and the water content of the molding sand, and by referring to that data, the capacity of the molding sand filling cavity, the positions and strength of the aeration, and the strength of the pressurized air flow or the pressurized air surge are controlled, the molding can surely be performed.

According to the molding system with molding frames having a pattern plate, a molding frame that can be put on the pattern plate, a filling frame that can be put on the molding frame, a covering apparatus having a plurality of squeezing feet that can enter the filling frame and that can be temporarily held at certain positions where certain distances are kept between the lower ends of the squeezing feet and surfaces of patterns on the pattern plate, which surfaces are opposed to the lower ends, and a sand supplying apparatus for supplying molding sand to the molding sand filling cavity that is defined by the pattern plate, the molding frame, the filling frame, and the covering apparatus, which system is characterized by sensors for measuring the reaction forces to respective squeezing feet, a storage device that stores molding data based on the measurements of the sensors for measuring reaction forces, and a distance calculation device for calculating distances between the lower ends of the squeezing feet relating to the molding sand filling cavity and the patterns on the pattern plate that are opposed to the lower ends of the squeezing feet, the molding sand that must be removed can be minimized. Also, the density of the mold within the molding frame can be uniform.

According to the molding system wherein the sand supplying apparatus has a plurality of nozzles, positions to which it is difficult to supply molding sand can be decreased over the prior art.

According to the molding system wherein respective aerations can be performed at lower parts of the nozzles, positions to which molding sand is supplied can be selected. Also, an excess of and lack of the molding sand can be overcome.

According to the molding system further including a closing member that closes the lower parts of the nozzles, and an air supplying apparatus for introducing air after the molding sand is supplied, the molding sand can be prevented from reversely flowing to the molding sand supply apparatus.

According to the molding system wherein molding data that is stored in a storage device of a controller of a molding apparatus with molding frames can be used as past molding data, molding data that is stored in a storage device of a controller of the molding apparatus can be used as previous molding data, so that experiences can be effectively used when the molding apparatus is controlled.

According to the molding system wherein the past molding data is commonly used by computers that store molding data in other molding apparatuses through the controller of the molding apparatus with molding frames, the molding data can be used for various molding apparatuses that even have different sizes, different types, and different positions and strengths of compressed-air flows and aeration.

According to the molding system wherein the past molding data is also commonly used by computers that store sand processing data or sand mixing data through the controller of the molding apparatus with frames, the sand processing data and the sand mixing data can be used so that a molding operation can be surely be performed according to the type of molding sands.

We claim:

1. A molding method for a molding apparatus with molding frames including the steps of defining a molding sand filling cavity that is substantially closed by positioning a molding frame on a pattern plate, positioning a filling frame on the molding frame, and positioning a covering apparatus on the filling frame, wherein the covering apparatus has a plurality of individually movable squeezing feet which are positioned to enter the filling frame and are temporarily held at certain positions where certain distances are kept between the lower ends of the squeezing feet and the surfaces of patterns on the pattern plate, which surfaces are opposed to the lower ends, thereafter filling the defined molding sand filling cavity with molding sand, and compressing the molding sand by means of the squeezing feet.

2. A molding method for a molding apparatus with molding frames of claim 1, the defining step further including a step of controlling the capacity of the molding sand filling cavity by moving the respective squeezing feet up and down.

3. A molding method for a molding apparatus with molding frames of claim 1, the defining step further including a step of controlling the capacity of the molding sand filling cavity by changing the distances between the surfaces of the patterns on the pattern plate and all the squeezing feet.

4. A molding method for a molding apparatus with molding frames of claim 1 further including a step for determining whether the density of the compressed molding sand corresponds to a preset value, wherein when the density of any part of the compressed molding sand differs from the preset value, the distances between the lower ends of the squeezing feet corresponding to that part and the upper surfaces of the patterns on the pattern plate are adjusted, and wherein when all parts of the compressed molding sand differ from the preset value, the distances between the lower ends of all the squeezing feet and the upper surfaces of the patterns on the pattern plate are adjusted.

5. A molding method for a molding apparatus with molding frames of claim 4 wherein the step of determining whether the density of the compressed molding sand corresponds to a preset value includes the steps of measuring reaction forces of the molding sand to the squeezing feet when the molding sand is squeezed in the molding sand filling cavity, and executing a calculation based on the measurements of the reaction forces.

6. A molding method for a molding apparatus with molding frames of claim 1 wherein the filling step includes the step of supplying compressed air to control the amount of the molding sand supplied to the cavity.

7. A molding method for a molding apparatus with molding frames of claim 6 wherein the filling step includes the step of supplying the molding sand through a plurality of nozzles.

8. A molding method for a molding apparatus with molding frames of claim 7 including the step of changing a feed of the molding sand by changing the amount of aeration to the respective nozzles according to the shapes of the patterns on the pattern plate.

9. A molding method for a molding apparatus with molding frames of any one of claims 1 to 8 further including the step of providing a pressurized air flow or a pressurized air surge after the molding sand is supplied.

10. A molding method for a molding apparatus with molding frames of claim 9 including the step of controlling any one of the capacity of the molding sand filling cavity, the positions and strength of the aeration, and the strength of pressurized air flow or pressurized air surge based on past molding data.

11. A molding method for a molding apparatus with molding frames of claim 10 further including the steps of storing the past molding data in a storage device of a controller of the molding apparatus with molding frames, and setting optimized values on the capacity of the molding sand filling cavity, the positions and strength of the aeration, and the strength of the pressurized air flow or the pressurized air surge before the relevant operations are performed during the molding operation by the molding apparatus with molding frames.

12. A molding method for a molding apparatus with molding frames of claim 10 wherein the step of storing the past molding data includes the step of connecting the past molding data to a computer that stores molding data for another molding apparatus through the controller of the molding apparatus with molding frames, and wherein the step of setting optimized values includes the step of calculating the optimized values in the computer, so that optimized values on the capacity of the molding sand filling cavity, the positions and strength of the aeration, and the strength of the pressurized air flow or the pressurized air surge are set.

13. A molding method for a molding apparatus with molding frames of claim 11 further including the steps of connecting the past molding data to a computer that stores sand processing or sand mixing data through the controller of the molding apparatus with molding frames, and using the sand processing or sand mixing data to determine the optimized values on the capacity of the molding sand filling cavity, the positions and strength of the aeration, and the strength of the pressurized air flow or the pressurized air surge.

14. A molding method for a molding apparatus with molding frames of claim 13 further including the steps of including additional data relating to compactability of the molding sand and water content of the molding sand in the sand mixing data, and referring to that additional data in controlling the capacity of the molding sand filling cavity, the positions and strength of the aeration, and the strength of the pressurized air flow or the pressurized air surge.

15. A molding system with molding frames having a pattern plate, a molding frame adapted for positioning on the pattern plate, a filling frame adapted for positioning on the molding frame, a covering apparatus having a plurality of squeezing feet adapted to enter the filling frame and adapted to be temporarily held at certain positions where certain distances are kept between the lower ends of the squeezing feet and the surfaces of patterns on the pattern plate, which surfaces are opposed to the lower ends, wherein a substantially closed molding sand filling cavity is defined when the pattern plate, the molding frame, the filling frame, and the covering apparatus are positioned together, and a sand supplying apparatus for filling the defined molding sand filling cavity with molding sand following the positioning together of the pattern plate, the molding frame, the filling frame and the covering apparatus, and further including sensors for measuring reaction forces to respective squeezing feet, a storage device that stores molding data based on the measurements of the sensors for measuring reaction forces, and a distance calculation device for calculating distances between the lower ends of the squeezing feet relating to the molding sand filling cavity and the patterns on the pattern plate that are opposed to the lower ends of the squeezing feet.

16. A molding system of claim 15 wherein the sand supplying apparatus has a plurality of nozzles.

17. A molding system of claim 16 wherein respective aerations are performed through the nozzles.

18. A molding system of claim 17 further including a closing member that closes the lower parts of the nozzles, and an air supplying apparatus for introducing air after the molding sand is supplied.

19. A molding system of claim 18 wherein molding data that is stored in a storage device of a controller of a molding apparatus with molding frames are used as past molding data.

20. A molding system of claim 19 wherein the past molding data is commonly used by computers that store molding data in other molding apparatuses through the controller of the molding apparatus with molding frames.

21. A molding system of claim 20 wherein the past molding data is also commonly used by computers that store sand processing data or sand mixing data through the controller of the molding apparatus with molding frames.

* * * * *

UNITED STATES PATENT AND TRADEMARK OFFICE

CERTIFICATE OF CORRECTION

PATENT NO. : 6,470,953 B1
DATED : October 29, 2002
INVENTOR(S) : Minoru Hirata et al.

It is certified that error appears in the above-identified patent and that said Letters Patent is hereby corrected as shown below:

Title page,
Item [73], please change "Singtokogio" to -- Sintokogio --.

Signed and Sealed this

Fourth Day of March, 2003

JAMES E. ROGAN
*Director of the United States Patent and Trademark Office*